United States Patent [19]

Crambes

[11] Patent Number: 4,832,535

[45] Date of Patent: May 23, 1989

[54] PROCESS FOR COMPACTION-REINFORCEMENT-GROUTING OR FOR DECOMPACTION-DRAINAGE AND FOR CONSTRUCTION OF LINEAR WORKS AND PLANE WORKS IN THE SOILS

[76] Inventor: Michel Crambes, 56, rue de l'Oise, Compiegne, France

[21] Appl. No.: 899,294

[22] PCT Filed: Nov. 27, 1985

[86] PCT No.: PCT/FR85/00337

§ 371 Date: Aug. 7, 1986

§ 102(e) Date: Aug. 7, 1986

[87] PCT Pub. No.: WO86/03533

PCT Pub. Date: Jun. 19, 1986

[30] Foreign Application Priority Data

Dec. 7, 1984 [FR] France ..... 84 18690
Nov. 7, 1985 [FR] France ..... 85 16480

[51] Int. Cl.[4] ..... E02D 3/02; E02D 3/12

[52] U.S. Cl. ..... 405/266; 405/117; 405/241; 405/262; 405/271

[58] Field of Search ..... 405/241, 260, 262, 271, 405/117, 233, 266, 269

[56] References Cited

U.S. PATENT DOCUMENTS 3,228,153 1/1966 Luedloff .
3,512,366 5/1970 Turzillo ..... 405/241
4,036,026 7/1977 Assayama ..... 405/262
4,044,513 8/1977 Deike .
4,079,592 3/1978 Eakin ..... 405/260

FOREIGN PATENT DOCUMENTS 2133593 7/1973 Fed. Rep. of Germany .
2431113 1/1976 Fed. Rep. of Germany .
2700858 7/1978 Fed. Rep. of Germany .
2144079 2/1973 France .
2563852 11/1985 France .
2106849 4/1983 United Kingdom .

*Primary Examiner*—David H. Corbin
*Attorney, Agent, or Firm*—Fleit, Jacobson, Cohn & Price

[57] ABSTRACT

Process for soil treatment and successive installations of a plurality of equipments at different respective locations and apparatus for implementing said process, comprising the operations of: drilling the soil by driving a tubular stem tool having an axis and a predetermined overall diameter around its axis, introducing one equipment inside the tubular stem tool, removing from the soil said tubular stem tool while leaving the equipment within the soil, modifying the soil compacity around the equipment by mechanical action during at least part of the removal of the tubular stem tool and repeating the above operations with remaining equipments at other locations.

22 Claims, 12 Drawing Sheets

PROCESS FOR COMPACTION-REINFORCEMENT-GROUTING OR FOR DECOMPACTION-DRAINAGE AND FOR CONSTRUCTION OF LINEAR WORKS AND PLANE WORKS IN THE SOILS

BACKGROUND OF THE INVENTION

The present invention concerns a process for:

1. Soil treatment, either by reinforcement grouting—compaction, or decompaction—drainage, or a combination of these two actions.

2. Linear works construction inside the ground with compaction or decompaction of the surrounding soil.

3. Plane works construction inside the ground, said plane works consisting of either reinforced—grouted—compacted soil, or decompacted—drained soil, or a combination of these two types of treated soils.

A linear work inside the ground, means any civil work constructed inside the ground, realized either from the ground level or from the sides or the bottom of an excavation, and for which one dimension, in the downwards direction, is substantially greater than its dimensions in the two other perpendicular directions.

A plane work inside the ground means any work involving a continuous or integral mass of soil which forms a volume having one dimension smaller than its two other dimensions.

FIELD OF THE INVENTION

The invention is particularly suitable for use in the field of soil treatments, either for structures foundation on the treated soils, or for improving soil stability or soil imperviousness, and in the field of construction of linear works inside a ground which has to be ameliorated structurally by compaction, or decompaction. Such linear works are for example piles, micropiles, drains, water wells, anchors, special tubes for grouting, measuring equipments such as piezometers, inclinometers, measuring cells, etc... A linear work may, or may not, include metallic elements, and may, or may not, be surrounded with build-up materials. The invention is also suitable for plane work constructions inside the ground, such as for example constructions involving the treatment of excavation sides and bottoms necessary to perform said plane works construction, supporting walls formed with compacted, grouted and reinforced soil, watertightness walls and ground draining walls, or combination of the above mentioned constructions for obtaining twin-layer, multi-layer or composite walls, impervious, draining or composite (twin-layer or multi-layer) rafts, etc...

With the process of the invention it is possible to obtain by use of a single tool, lowered only once into the ground, either a mechanically compacted, grout treated and reinforced soil, or a decompacted soil equipped with drains, or a unit linear work surrounded by compacted or decompacted soil.

STATE OF THE ART

Numerous methods or processes for mechanical compaction, grout treatment and introduction of equipments inside the grounds in order to modify mechanical and/or watertightness soil characteristics are already known. Many processes for drainage and installation of piles, anchors and measuring equipments inside the ground, at different depths, are also already known by the man skilled in the art.

Generally, the known processes are directed either to soil treatment per se, usually consisting of compaction or grouting, or to installation of an equipment within the soil, the installation being for example followed by treatment of the surrounding soil, for example by grouting.

The existing processes do not permit simultaneous realisation of all the desirable or useful operations, necessary for installation of the equipment inside the ground and for the compaction and/or treatment of the surrounding soil. On the contrary the existing processes need, either to perform two successive operations, in order to obtain the required result (e.g. installation of micropiles, then soil grouting around their lower part in order to obtain the anchoring zone), or to be limited to only one operation (e.g. single soil compaction, without introduction of reinforcements).

SUMMARY OF THE INVENTION

It is an object of the invention to provide an improved process or method which allows, with a single or sole tool and in a single in-out operation of introduction and withdrawal of the tool from a soil, to perform the set of following operations:

1. Drilling the soil.

2. Installation of reinforcement, metallic or plastic equipment or build-up material within the soil.

3. Formation of a sheath around the reinforcement or the metallic or plastic equipment, said sheath consisting of a grout, a mortar or a build-up material.

4. Mechanical compaction (or decompaction) of the soil around the equipment or the sheath, said equipment or sheath forming a civil work, by mechanical action and/or also by vibration or percussion.

5. Grouting whithin the soil under pressure around a civil work.

6. Formation of enlarged zones for a civil work, said zones being filled up with build-up materials, and for example further application of pressure upon the soil around the walls of the civil work and/or grouting within the soil itself.

It is another object of the invention to provide a process with very broad application as it gives solutions to most soil treatments problems or problems of construction of linear works within a soil, which require whatever combination of the above mentioned operations.

Another object of the invention is to provide an improved process which allows combination of all the operations mentioned, as to the relative importance of said operations at different respective locations in the soil as well as to the choice of the operations to be applied according to the various depth zones of a predetermined civil work to perform.

It is therefor possible to realize combined treatments of a soil including either enlargements, or compactions, or decompactions, according to the characteristics of the ground at each respective depth of the ground.

Another object of the invention is to provide a process which renders possible to execute soil treatment around a civil work, after the installation of an equipment of said civil work and around it, thereby achieving a perfect junction or connection between the treated ground and the equipment.

To this end, the invention provides processes and apparatuses according to the following description.

DESCRIPTION OF THE TOOL AND THE MACHINE OF THE APPARATUS

1. THE TOOL (a) The tool is a hollow tubular stem tool, for example a continuous flight auger. In the following description, this particular configuration will be considered for clarity, although a hollow tubular stem tool different from an auger may be used. The auger may be either constructed in one single piece, or constituted by unit elements removably connected to each other. The auger is or is not fitted at its lower end with a hard metal drilling tip or bottom tool or drilling tool, for example spin-shaped, which makes it possible to drill through hard layers in the ground. This drilling tool may be either coupled to the lower extremity of the auger tubular stem by friction, or connected to it with a bayonet or a short, threaded piece, previously greased.

(b) The bottom tool, in case it is used, is to be abandoned at the bottom of the borehole after the end of the drilling operation. The uncoupling between bottom tool and auger is performed either by driving it away with fluid pressure (compressed air, water, grout or other), or by unscrewing or bayonet unlocking, once the bottom tool is stuck in the soil at the bottom of the borehole.

(c) The bottom tool may be supplied, at its upper end facing the inside part of the auger stem tube, with a female threaded piece, topped by a conical bore which is used as a guide for a male threaded tip at the bottom of the equipment to be introduced, when necessary as decided. It is thus possible to connect by screwing the bottom tool and the equipment. This connection:

1. facilitates, if necessary, unscrewing of the bottom tool, by transmission through the equipment of the necessary (driving or resisting) torsion torque;

2. facilitates, if necessary, immobilization in place of the equipment during the subsequent withdrawal of the auger, by providing an anchoring point in the soil at the bottom of the borehole, due to friction of the bottom tool in the soil (in particular if this bottom tool is helicoid-shaped).

(d) The bottom tool may be equipped with a harpoon-type system featuring elastic metallic strips which are initially folded against its shaft during the lowering operation, but expanding in the soil for preventing its withdrawal, therefor increasing its adherence in the soil against any withdrawing when it is uncoupled from the auger bottom.

(e) The auger stem tube may be or may not be supplied internally or externally with another tube, of smaller diameter, tied up to one of its generatrices, which will be used if necessary to bring grout or another fluid material down to the bottom of the auger. The bottom of the stem tube may then be equipped with an annular distributor, used for spreading the grout along the whole periphery of said distributor through openings peripherally disposed. The openings may be or not equipped with one-way valves.

(f) Other auxiliary tubes may also be tied up, if necessary, to other generatrices of the auger stem tube, with one of their extremities disposed at various levels along the auger stem tube.

2. THE MACHINE (a) The machine essentially comprises a long mast (the length of which exceed by some meters the length of the equipment to be installed). A mast shorter than the equipment length may also be used, but in that case it will be necessary to use an auger formed with a plurality of unit sections to be connected together. The mast is supported by a heavier carrier, for example a crawler, and is equipped with a powerful rotary head, for example hydraulically driven, designed for rotation in both directions and for sliding along the mast controlled by a reversible driving system (through chain, jacks, winches or any other system).

(b) The driving head may include or may not include a compound system for rotary-percussion, or rotary-vibration, thus allowing to improve the compaction of the soil around the reinforcement. If the driving head is only rotary, it may also be surmounted by a percussive head or by a vibrator, sliding along the mast, for coming in contact on top of said mast and operated when desired during the operations of the process.

(c) The driving head is annular and presents a hollow space or bore along its axis. The upper part of the head is connected through a fluid injection swivel with rotating joints known per se and a swan neck tube to a grouting station for injecting the materials (for example cement grout, mortar, microconcrete). The swan neck tube is equipped with a straight branch ended with a flange centered about the axis of the auger. The flange is closed either with a simple cover or with a stuffing box device.

(d) For introducing the equipments, the machine is equipped, either with a simple winch for lifting the equipments along the mast, or with a feed drum system for feeding several equipments, or with a reeling system comprising a drum on which the reinforcements are winded, when it is planned to introduce flexible reinforcements such as cable strands or flexible bars.

(e) The machine may be equipped with an auxiliary rotary or roto-percussion head, or with a vibratory head, which may be rotary or not, when it is desired to act on the equipment itself, the auxiliary head being designed for sliding along the mast, independently from the main head.

(f) The machine may be equipped, towards its lower end or its upper end, with a powerful cutting press for cutting the equipment to the desired length, when a reinforcement is unwinded from a reeling drum, or in the case of equipments with varied lengths which have to be adjusted individually.

(g) It is also possible to use a driving head which is not annular, but in this case, the head will have to be disconnected from the auger and lifted along the mast or shifted laterally before introducing the equipment.

DESCRIPTION OF THE METHOD

1. Drilling (a) The drilling is performed with the auger, in a known manner. The outside diameter of the auger helix is selected according to the characteristics of the soil, and those of the machine. When it is planned to form enlargements alongside the work, the outside diameter of the auger helix should be the same as the diameter of the planned enlargements.

(b) If the soils are soft enough, it may be possible to drill without bottom tool. After drilling, the inside of the tube which forms the auger stem is cleaned with water, compressed air, or a mix or emulsion of both, for example through auxiliary tube(s) as described above, or with a flushing pipe string.

(c) If the soils include hard layers, the drilling is performed with a bottom tool. The inside of the auger stem is kept clean or free of any soil material.

(d) It is then possible to fill the inside of the auger with grout, either through the auxiliary tube, or through the above mentioned pipe string.

2. Installation of the Equipment

The installation of the equipment is performed through the hollow of the tube forming the auger stem. There are several possibilities for installing the equipment:

(a) The equipment may be introduced inside the hollow auger stem through the upper flange, eventually coupled with a steel bar which is used for supporting it at its upper end, with a bayonet type system.

The lower end of the equipment is, if it is desired, introduced and screwed into the conical part of the bottom tool. In case of drilling without bottom tool, the equipment may be equipped at its lower end with an anchoring system, harpoon type, in order to prevent its withdrawal, similar to the one mentioned above for the bottom tool. Similar anchoring devices may be fitted from place to place alongside the equipment, for preventing withdrawal as well as for centering purpose.

After unscrewing, uncoupling or driving away of the bottom tool, and eventually disconnecting the temporary support bar from the upper end of the equipment, the cover of the upper flange is closed.

(b) The equipment may be, after its introduction, topped with a string of flush rods, connected to an auxiliary head which remains at the top of the mast. In that case, there is an absolute warranty that the equipment will really stand in position when the auger is withdrawn.

The grouting is then executed, either through the upper rod string and a tube incorporated to the reinforcement, down to its lower end, or through an auxiliary tube, or through the annular space existing between the reinforcement and the tube forming the auger stem. In the two first mentioned cases, the auger stem may or may not be left open at its upper end, in the third case, it is necessary to install a stuffing box at the upper end.

The driving head, being annular, leaves an inner hollow space for the rods. Thus, the auger is raised around the rod string. The uncoupling of the rod string from the equipment is done when the lower end of the auger has been enough raised along the mast so that the place of the junction between equipment and rod string is cleared.

(c) The above mentioned rod string may be constituted by the equipment of the next hole itself. Then a repetitive process may be performed, the machine being loaded during each operation with the equipment of the next hole, said equipment being temporarily connected to the equipment of the hole presently equipped.

(d) If the reinforcement is constituted by cable strands or flexible bars, it may be unwinded from a feeding drum, installed or not on the machine, and carried over a pulley at the top of the mast. It passes through the stuffing box fitted at the upper end of the swan neck tube as described above.

Thus the reinforcement is introduced into the ground as required, with the needed lengths. The machine is thus operating like a "sewing machine", inserting varied lengths of reinforcement into the ground. The cutting device, fitted to the lower part of the machine, cuts the reinforcements to the desired length, for each of the respective reinforcements. An auxiliary head, installed at the top of the mast, ensures the unwinding of the reinforcement from the feeding drum and its immobilisation during the auger withdrawal.

(e) As an alternative to the above mentioned methods (a) and (b), the equipment may be introduced during the drilling operation, according to the following method: each time and for each location in the soil to be equipped and treated, the drilling is executed with the equipment installed inside the stem, either connected at the top of the stem, for example through a temporary supporting bar, or connected at the bottom of the stem by screwing into the bottom tool if there is one, or otherwise maintained at the top of the stem by an auxiliary head sliding along the mast simultaneously with the main head driving the auger. The equipment is therefor lowered at the same time as the auger, unlike the cases described in (a) and (b) above, in which the equipment was lowered after the drilling operation.

The auger is withdrawn, by raising the auger around the equipment of the next hole, which has been previously presented centered along the auger axis. The use of a stuffing box as previously mentioned above or of an auxiliary tube as described in a previous paragraph makes it possible to execute the grouting operations during the withdrawal.

If the equipment is a flexible reinforcement unwinded from a drum, the cutting tool installed at the lower part of the mast cuts the reinforcement after raising the auger, and then if desired, the end of the next equipment may be connected to a new bottom tool, if such tool is used. The machine is then ready for executing the next hole.

(f) The process enables also to construct works in the ground constituted by a build-up material, such as for example concrete, mortar, grout, aggregates or sand. In that case, the equipment is replaced by the build-up material, which is introduced into the stem either by pumping, or by use of gravity, through a funnel on top of the tube.

(g) Extension of the process to the case of soft soils underlaid by rock or harder ground: in that case, if it is juged necessary or preferable to place the lower part of the equipment (or of the build-up material) along a predetermined height inside the rock or the hard ground, the following method is performed: the drilling through the soft soil is executed with the auger, either open at the bottom or equipped at the bottom, with a bottom tool, (roller bit, fish tail or other) which will be used for the subsequent drilling of the rock or the hard ground. In this latter case, the string of rods which will drive the bottom tool may be already present inside the auger during the drilling of the soft soils. The string of rods is driven either by the main head, or by an auxiliary head sliding along the machine mast. After drilling in the rock, the rod string is removed and the bottom tool is either recuperated or left in place at the bottom of the hole. The rod string may be constituted, if desired, by the equipment itself, if it is rigid enough to transmit the corresponding forces or torques and under condition that it includes a duct for the drilling fluid (tubular equipment for example). In that case the drilling tool is left in place at the bottom of the hole, at the lower end of the equipment.

3. Formation of the Sheath Around the Equipment

After the equipment has been installed, one raising of the auger is initiated. A build-up material (for example cement grout, mortar, microconcrete) is then introduced by pumping or by filling, either through the tube forming the auger stem, around the equipment, or through the auxiliary tube described above. Then the build-up material fills the volume left by the auger tube around the equipment. It constitutes a sheath around the latter for protection, and for support and junction with the surrounding soil if it is constituted by a hardening material (for example grout, mortar or concrete).

4. Mechanical Compaction (or Decompaction) of the Soil Around the Equipment (a) During the raising of the auger, and simultaneously with the installation of the above described sheath, the auger is rotated in the direction opposite to the direction of rotation performed during drilling, and at the same time the auger is progressively withdrawn.

(b) The opposite direction rotation speed is, as a minimum, the one which corresponds to a simple unscrewing of the helix, taking into account its vertical extraction speed and its pitch, leaving in place the materials which are around the auger stem between the blades of the helix. An opposite direction rotation speed which is slightly higher produces the compaction of the soil. The compaction is achieved by simple mechanical effect, by pressure of the auger blades upon the ground confined between them, and by a dragging down effect on the surrounding soft soil which tends under its own weight to take the place of the voids produced by the compaction. Build-up materials may be dumped around the auger at the top of the hole in order to compensate the settlings or compression produced by the compaction.

(c) The mechanical compaction is improved, if desired, by percussion or vibration with special heads as described above. The effect of such percussion or vibration may be very important and may increase considerably the range of action of the compaction inside the ground.

(d) On the contrary it is also possible to decompact the ground around the equipment, with the auger, by selecting an appropriate rotation speed of the auger compared to its withdrawal speed. The installation inside the auger hollow stem of either a draining tube or a sand or gravel filling, or both, makes it possible to obtain a drain with improved draining capacity. It is possible to realize in this way a general drainage treatment of a soil by installing a network of a plurality of drains of this type.

(e) Composite systems are also possible, featuring the drainage of certain layers and the compaction of the other ones, according to whatever predetermined combination.

(f) The compaction by percussion or vibration is performed either through action of the special head(s) described above upon the auger itself, or by action of the auxiliary head described above upon the equipment itself, when the equipment is either connected to a string of rods, or connected to the next equipment, or is a continuous equipment.

In case of a reinforcement which is submitted to vibration, this produces a compaction effect upon the materials which constitute the sheath around the reinforcement and upon the surrounding ground. Both action (upon the auger and upon the reinforcement itself) may also be combined, making it possible to obtain the maximum desired compaction.

5. Treatment of the Ground Around the Reinforcement by Grouting Under Pressure (a) During the operation of unscrewing and withdrawal, accompanied by the mechanical compaction described above, it is possible to apply a treatment by grouting under pressure with cement, mortar or another grout, according to the nature of the soils.

(b) The grouting is performed, as the sheath described above, either through the inside of the auger stem, or through one or a plurality of auxiliary tubes as described above.

The grouted material is then, but not compulsorily, the same material as the material of the sheath. This one occupies the volume which is left around the reinforcement, as well as the volume which is left by the auger helix when it is unscrewed, and it penetrates the soil while injecting the material.

(c) It is thus obtained by combination of the effects of the above mentioned operations, a soil which is at the same time reinforced, mechanically compacted (by simple mechanical effect and/or by dynamical effect of percussion or vibration) and grouted under pressure. The soil is treated in situ, around the reinforcement, to which it is perfectly fixed, progressively, on its whole height. This constitutes a process of soil treatment and reinforcement, particularly efficient and complete. The compaction effects obtained by mechanical way and by grouting combine together and are added to each other and it is possible to obtain all the degrees of compaction which are desired.

(d) The rotation and withdrawal speed of the auger, as well as the grout injection pressure and flow, and the importance of the dynamic compaction (percussion or vibration), may be servo-controlled, in order to obtain all possible combinations of these parameters, as well as the maintaining according to constant ratios of the parameter combinations best adapted to each particular circumstance.

6. Formation of Enlarged Zones Around the Equipment (a) It is possible to form around the equipment enlarged zones (bulbs) constituted by build-up materials (for example grout, microconcrete, mortar, or granular fill materials). For that purpose, one needs only to simply raise the auger, without rotation, while injecting the material by pumping, or by simple gravity filling. In case of necessity, the auger is rotated very slowly in the same direction as for drilling in order to avoid mixing the build-up material with the soil. When the placing is done by pumping, the mix which constitutes the material is prepared in an external batching, mixing and pumping unit. It is pumped under pressure to the bottom of the auger with a grouting pump, either through the inside of the hollow stem around the equipment, or through auxiliary tube as previously described. The pressure which is maintained at the bottom renders possible a complete filling of the void formed under the auger by the raising of the auger, on a diameter corresponding to the external diameter of the helix. The surrounding soil is maintained compressed by the pressure of the fluid. It may be grouted under higher pressure if necessary.

The bulb may also be constituted by draining materials.

(b) This type of enlargement may be formed either at the lower part of a work, or at any level along the work. A plurality of enlargements may also be formed at various levels, separated for example by zones of compacted soils.

(c) The formation of enlarged zones may also be executed by a process of directional, very high pressure grouting (process type "jet grouting"), through special rods lowered inside the stem. In that case, the diameter of the enlargement may become greater than the diameter of the auger helix.

SHORT DESCRIPTION OF THE DRAWINGS

The description refers to the accompanying drawings in which.

DESCRIPTION OF PREFERRED EMBODIMENTS

I - Example of Construction of a Linear Work in a Soil: Case of a Ground Anchor Successive steps of a ground anchor construction in the ground are represented on FIGS. 1–6.

Figure 1:
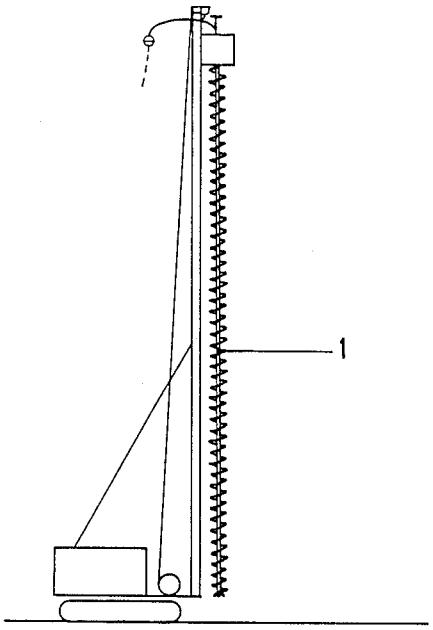
FIGS. 1–6 are diagrammatic views of an apparatus comprising a tubular helicoidal auger according to a preferred embodiment of the invention, showing the apparatus at different steps of a process for soil treatment and installation of a ground anchor in a soil, according to the invention.

FIG. 1 shows the setting-up of the machine to the place or location of the future work, consisting of the ground anchor.

Figure 2:
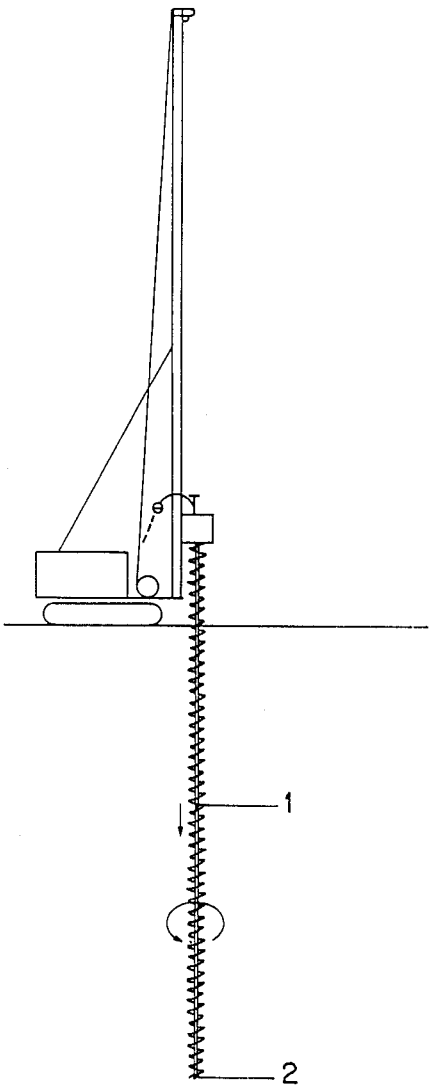

FIG. 2 represents the drilling with the auger 1, to the final depth of the work. The auger is equipped with a bottom tool 2, designed for piercing the hard layers in the ground. The bottom tool 2 is screwed through a wide pitch, right hand thread upon the tube forming the auger stem. Before screwing, the thread is greased, which will facilitate the subsequent unscrewing. During drilling, the auger is rotated in the right hand direction (clockwise). The bottom tool is equipped at its upper end with a wide pitch, right hand thread topped with a conical bore.

Figure 3:
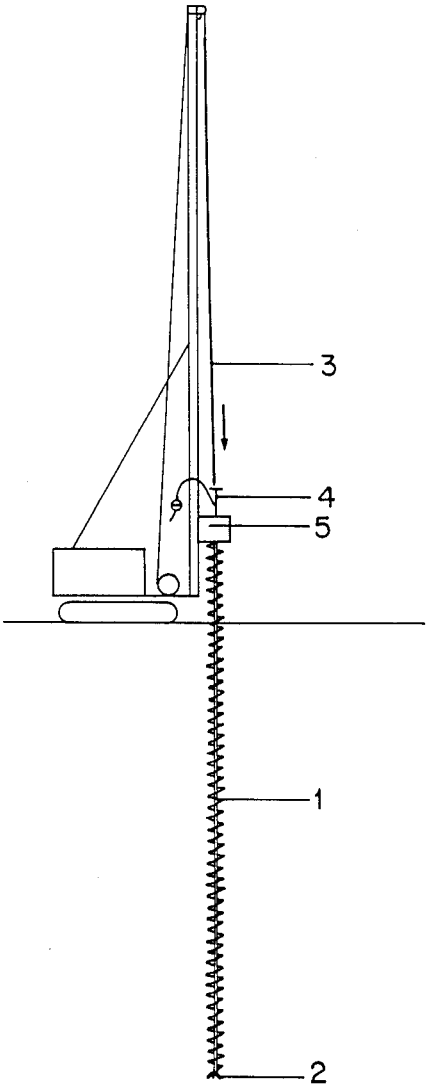

FIG. 3 represents the installation of the reinforcement 3, inside the tube forming the auger stem, through the axial tube 4 topping the annular rotary head 5. Prior to placing the reinforcement, the tube forming the auger stem has been filled up with cement grout, either through a string of pipes lowered inside the tube, or through an auxiliary small diameter tube tied up along a generatrix of the stem tube. The reinforcement, which consists here in a simple high yield steel bar, is provided at its lower end with a wide pitch, right hand threaded tip. After the reinforcement has been lowered down to the bottom of the tube, its threaded tip is introduced into the female thread of the bottom tool, guided by the conical bore or broaching topping this thread. The reinforcement is screwed onto the bottom tool, after which, by keeping rotating the reinforcement in the right hand direction (clockwise), this produces the unscrewing of the bottom tool, which is driven away from the auger stem.

Figure 4:
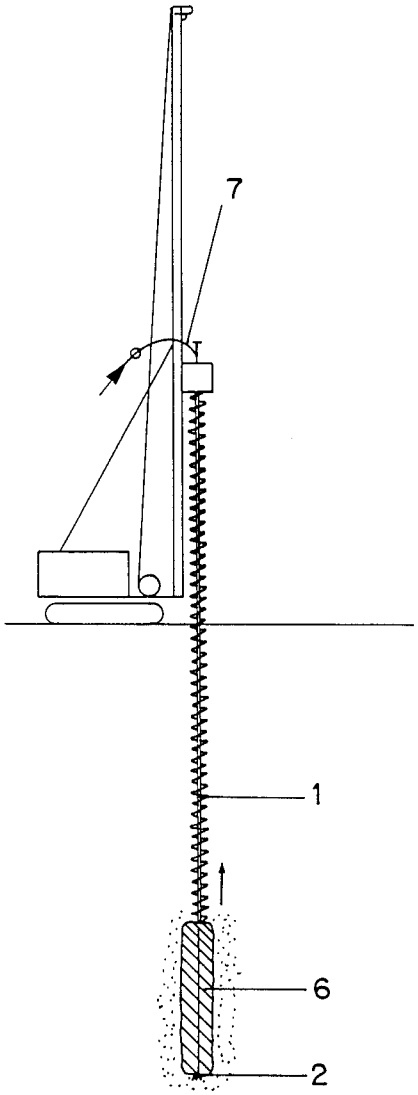

FIG. 4 represents the formation of an enlargement (6) at the lower part of the work, in the anchoring zone of the anchor in the ground. The enlargement is formed by simply raising the auger, and at the same time forcing cement grout under pressure through the swan neck tube (7) topping the rotary head. During this operation, the reinforcement remains in the borehole while the auger is raised. The diameter of the formed enlargement (anchoring bulb of the ground anchor) is equal to the outside diameter of the auger helix. The soil around the enlargement is maintained compressed under the pressure of the grout, which is pumped with a grouting pump.

Figure 5:
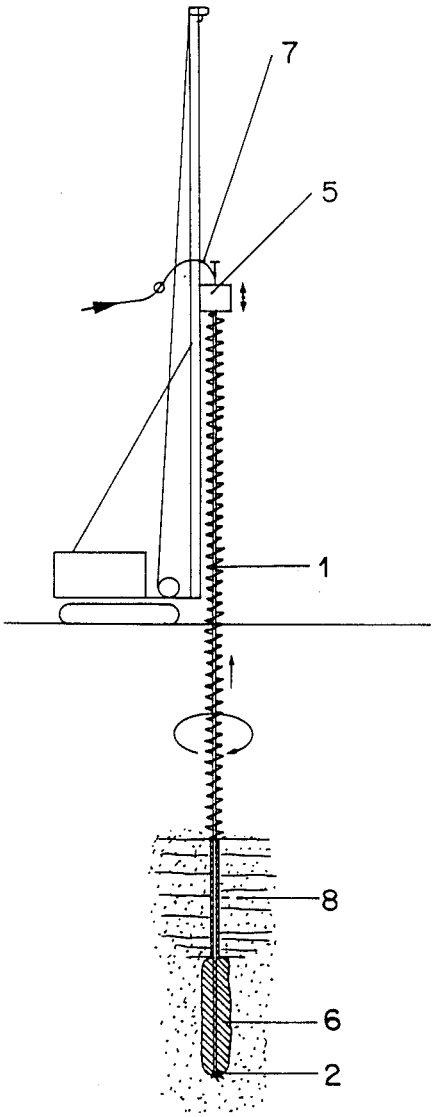

FIG. 5 represents the compaction and the grouting treatment (8), around the reinforcement, upon a height of some metres above the enlargement previously formed at the lower part. The compaction is performed by pure mechanical action, by rotating the auger in the direction opposite to the direction during drilling, progressively during withdrawal, and by dynamical effect by action of impacts or vibrations produced by the rotary-percussion or rotary-vibration head (5) located at the top of the auger, and by injecting cement grout under high pressure into the soil through the tube (7). The zone of compacted soil, above the enlargement which forms the anchoring zone of the ground anchor, is used for trans-mitting to the surrounding ground the forces applied by the upper part of the enlargement, by "inverted toe effect", by analogy with the downwards "toe effect" applied to the ground by the lower end of a pile working under compression, and as opposed to the "lateral friction" effect which is applied along the contact surface between the shaft of the enlarged zone and the ground. It should be noted that the formation of an enlarged zone at the lower part improves considerably the capacity of the anchor, because the increase in diameter improves proportionally the "lateral friction" effect, while permitting to develop an important "inverted toe effect". The improvement which would be obtained would be equivalent in the case of a pile or a micropile working under compression. A pile-anchor, working sometimes under compression, sometimes under tension, benefits from the improvement in both directions.

Figure 6:
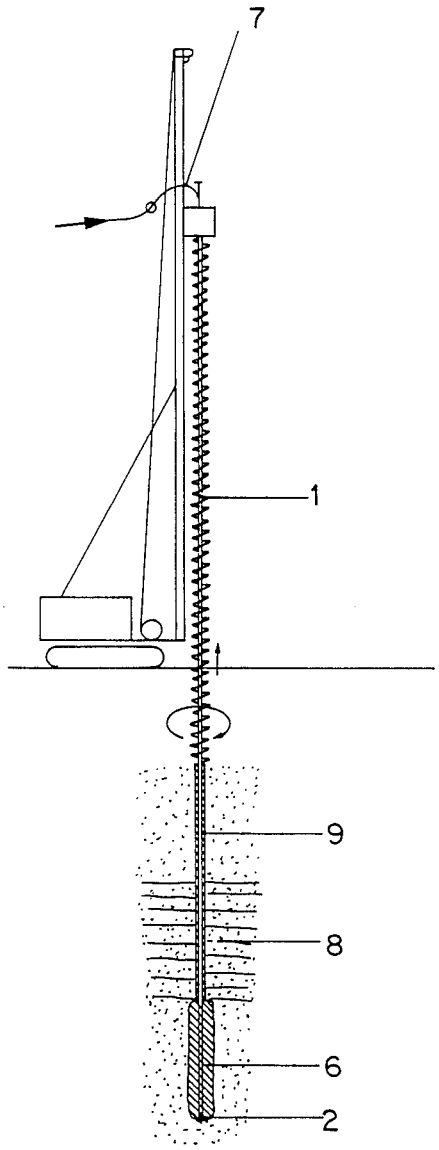

FIG. 6 represents a simple filling up with cement grout of the annular space (9) around the reinforcement, corresponding to the room precedently occupied by the tube forming the auger stem. It has been supposed that along the upper part of the work, corresponding to the free length of the anchor, the ground did not need to be compacted. It is evident that the compaction may always be effected if it is desired, for example if it was wished to warranty the reinforcement against the risk of buckling in case of a micropile.

Figure 7:
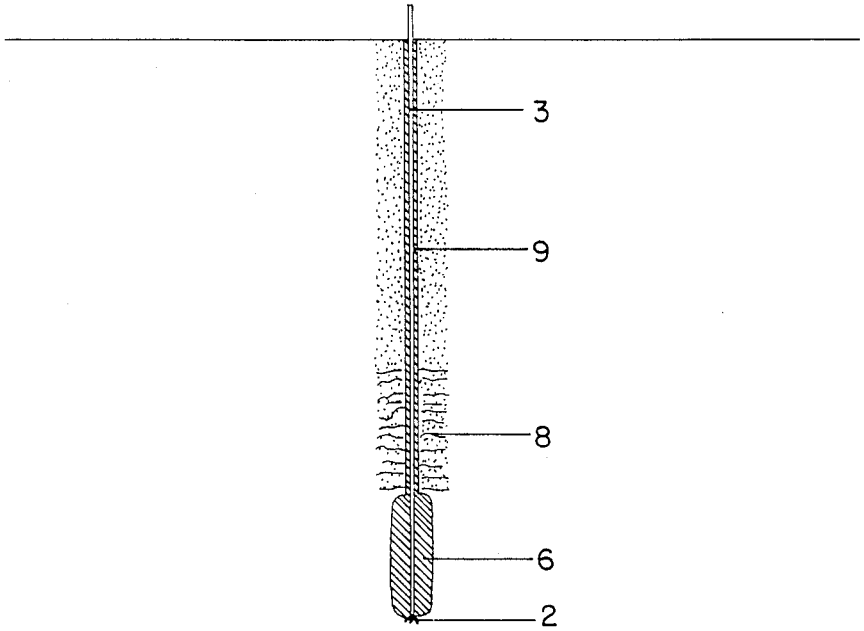
FIG. 7 shows the ground anchor, in sectional view, after completion of the steps of the process shown on FIGS. 1–6.

FIG. 7 represents the completed anchor, with its reinforcement (3), its anchoring zone at the lower part (6), its zone of ground compacted both mechanically and by grouting (8) and its free height simply wrapped with a protection sheath (9).

This type of ground anchor, installed in a short time, in a sequence of simple and efficient operations, is particularly well anchored in the ground and capable of high performances.

(II) FIELD OF USE OF THE PROCESS (a) The process may be used at industrial scale for:

1. The compaction and the grouting treatment of soils.

2. The drainage of soils.

3. The construction of linear works in the ground, equipped or not with an equipment, and for which the state of compaction of the ground around the work has to be controlled or modified.

4. The construction of plane works in the ground (see paragraph I below).

(b) The compaction, drainage or composite treatments may be applied to important surfaces of land, for example in case of treatment of the foundation soil before construction of a building complex or of civil work structures, or in order to stabilise a given volume of soil, for example to prevent a risk of landslide, or to modify the characteristics of active or passive pressure of the soil behind a structure.

In that case, the soil, mechanically compacted and grouted, may be equipped with reinforcements resisting to compression or to traction, or with drains. The soil is then compacted, grouted and reinforced, or decompacted and drained.

The grid of the treatment (spacing between neighbouring boreholes) is designed according to the nature and characteristics of the soil, to the results to be obtained, and to the range of action of each unit treatment.

The equipment which is introduced may be either metallic or plastic, or replaced by a simple filling with build-up materials. The settlings on top of the boreholes are compensated by dumping materials. Bulbs constituted by materials or by microconcrete or other grouts may be formed at various levels. The improvement of the soil characteristics which may be obtained with this process may be considerable. In any case, the servo-controlling between the rotation speed and auger raising speed, the importance of the dynamic compaction (percussion or vibration), and the flow and pressure of grouting or introduction of filling material makes it possible to control totally the treatment.

(c) Concerning the applications of the process to the construction of linear works in the ground with treatment of the soil around the work, we may quote the following, as non limiting examples:

1. Piles and micropiles: for which the formation of a bulb at the lower part increases the bearing capacity, and the compaction of the soil around the pile prevents the risk of buckling at the upper part, together with improving the bearing capacity produced by lateral friction along the pile. In case of existence of compressible soils above the foundation zone, the compaction performed at the upper part prevents the subsequent emergence of negative friction effects.

2. Ground anchors: for which the formation of a bulb at the lower part improves the anchor resistance by increasing the lateral friction and by producing an "opposite toe effect", and the compaction of the soil above the anchoring zone makes it possible to transmit the anchoring forces to the surrounding ground which is treated and compacted.

It should be noted that in the case of micropiles and ground anchors, the equipment which is introduced may be either the anchor or the micropile itself, previously prefabricated, or a tube, metallic or plastic, equipped or not with grouting sleeves ("tube à manchettes"), around which a grout of build-up material sheath is formed during the sugar withdrawal. This tube may have various uses:

it may be used as a protection organ for the reinforcement itself, which is lowered subsequently inside it, it may constitute by itself the anchor or the micropile, it may be used for a subsequent grouting if it is equipped with grouting sleeves.

In that latter case, the internal reinforcement of the anchor or micropile shall be introduced subsequently, after the complementary grouting through the grouting sleeves. The tube and/or the reinforcement may in some circumstances be lowered at a partial depth in the borehole, for example to the top of a bulb constituted by granular materials or by concrete formed at the lower part of the work.

3. Grouting boreholes: equipped with tubes, for example grouting sleeve tubes ("tubes à manchettes"). For these boreholes, the adjustable soil compaction, around the grouting sleeve tube for example, and the progressive and controlled formation of a plastic grout sheath along the whole height of the zone to be grouted, during the auger raising, are very important improvements and allow a rigorous control of the formed sheath and of its junction qualities with the surrounding ground. The possibility to operate a pregrouting of the ground during the auger withdrawal may constitute a considerable advantage, for example in the case of a ground including voids or decompressed zones.

When the grouting is planned with two or more phases, for example a first phase with cement grout and a second phase with chemical gels, it is possible to execute the first phase with cement grout directly through the inside of the auger or through an auxiliary tube the second phase only being executed subsequently through the grouting sleeve tubes.

4. Drains and piezometers: for which the formation of a zone of decompacted ground around the work, together with the installation of a filter material (sand or gravel) sheath around the tube, improve at the same time its catchment power and the filtration capability of the thinner soil elements. It is possible to install a plurality of piezometers or drains, by decompacting the soils in front of the layers to be drained, and compacting and grouting the soils in front of the layers to be masked.

5. Water catchment wells: for which both preceding effects are still more essential. It should be noted that in the process such as described, the drilling is performed without use of drilling mud, either bentonitic or other. This allows to avoid pollution of the aquifers in catchment as well as effect upon the ground around the well. On the contrary, as there is decompaction of the ground surrounding the filter sheath, the catchment power of the well is greatly increased.

As for the piezometers and drains, it is possible to install composite catchment wells, by decompacting the soil in front of the layers to be drained, and compacting and grouting the soil in front of the layers to be masked.

Enlarged catchment zones, with draining bulbs of greater thickness, may be formed at various levels along the well.

6. Measuring equipments: they may be various equipments, such as inclinometers, settlement meters, punctual pressure cell piezometers, or any other type of equipment which necessitate, in addition to the installation of the equipment itself and possibly of a build-up material sheath, the adjustment of the degree of compaction (or of imperviousness) of the surrounding ground to a suitable value.

7. Other works: the process may be applied to any linear work in the ground necessitating any type of combinations for example at different depths of the different operations already mentioned: presence or not of an equipment, embedding within a hardening material or a build-up material sheath, compaction or decompaction of the ground around the work, pressure grouting.

III-ARRANGEMENT FOR THE JUNCTION OF THE REINFORCEMENTS WITH AN OUTSIDE STRUCTURE

For executing works such as micropiles or anchors with the above described process, and if these works have to be executed through a slab, a wall or a reinforced concrete structure already constructed, it is necessary to introduce the auger through the structure, which necessitates an opening of a much greater diameter than the diameter of the reinforcement to be installed. Moreover it may be necessary to realise the continuity of the watertightness organ, when a soil with water under pressure exists underneath the slab or the structure, or outside the wall, in the final stage after the construction of the work.

1. Case of a Reinforcement Working Under Tension (Anchor)

Figure 8:
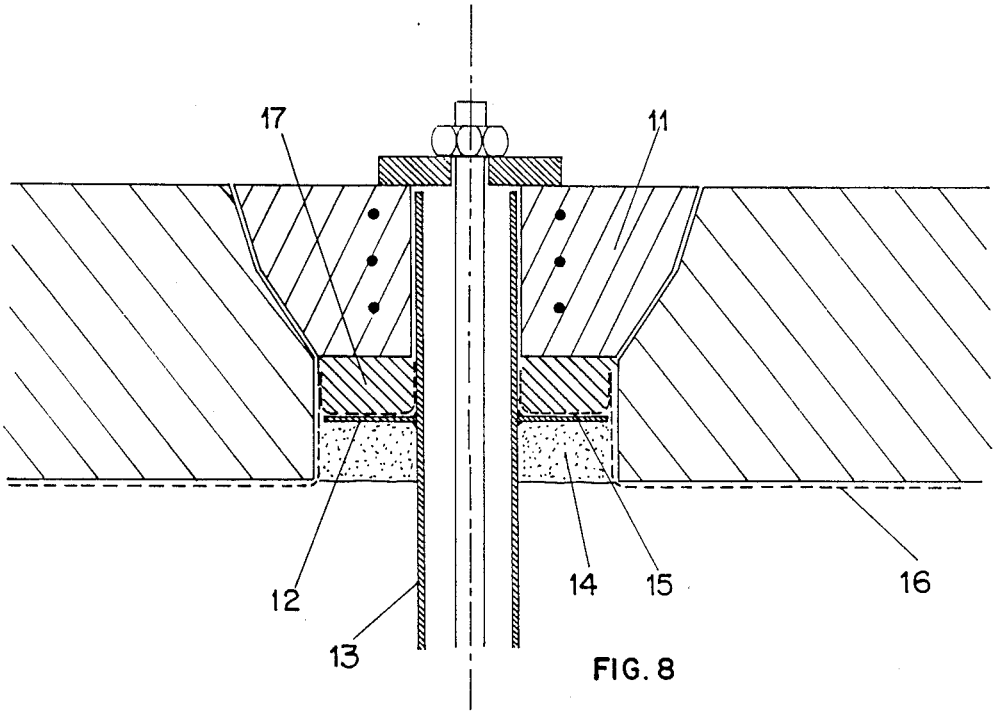
FIGS. 8–12 are sectional views of various anchor heads to be used on a ground anchor performed according to the invention, through an existing structure.

(a) The necessary special anchor head is represented on FIG. 8. It features:

a conical plug (11), in prefabricated or cast-in-place concrete (reinforced with a hoop and tight reinforcing bars), a flange (12) welded to the anchor external protection tube (13), upon which the watertightness connector will rest, a sand layer (or first phase concrete) (14) upon which the flange (12) will rest, a watertightness connector (15), for connecting the general watertightness membrane (16) of the work to the anchor protection tube. The watertightness connector is either glued, or simply resting upon the flange (12), a protective concrete layer (17) upon the watertightness connector.

Figure 9:
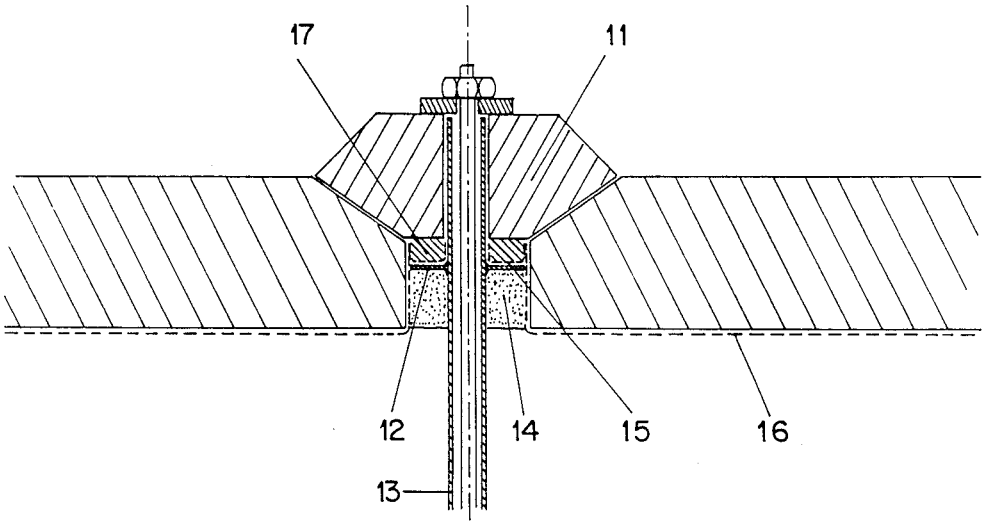
Figure 10:
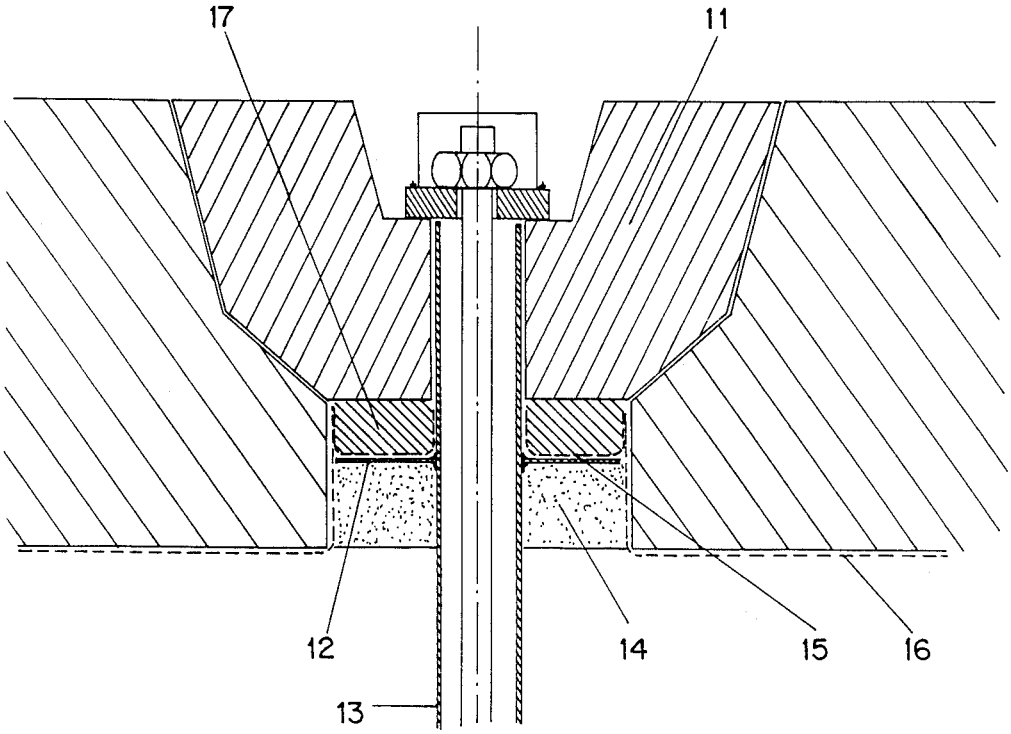

(b) The special imperviousness head may be constructed either inside the dimension in thickness of the slab, the wall or the structure, as represented on FIG. 8, or partially projecting outside the surface of the concrete structure, as represented on FIG. 9, so as to ensure a good transmission of tension forces to the concrete structure. It may include a recess making it possible for the anchor head not to project outside the surface of the concrete structure, as represented on FIG. 10.

(c) During drilling, reinforcement and material installation and withdrawal of the auger, a sheath (temporary metallic tube equipped with a support flange at the top) protects the general watertightness membrane, which is bended along the inner side of the opening in the concrete.

(d) The conical upper plug, if it is constituted by prefabricated concrete, may be or not resin glued inside the corresponding opening in the concrete structure. If it is not glued, it may be removable, making it possible to repair the anchor (for example by overdrilling).

2. Case of a Reinforcement Working Under Compression (Pile or Micropile)

Figure 11:
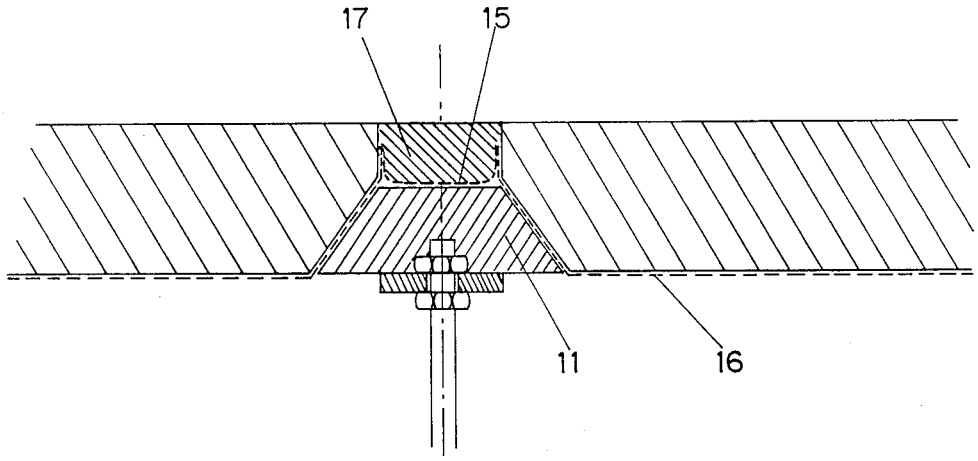

In that case, represented on FIG. 11, the prefabricated or cast-in-place concrete plug (11) is located at the underside of the structure, either inside the dimension in thickness of it as represented on the figure, or partially protruding downwards, in order to ensure a good transmission of the compression forces to the concrete structure. The watertightness connector (12) is simply resting (or glued) upon the upper face of the conical plug (11). It is topped with a protective concrete (13) cast-in-place last, the form of which may be slightly conical if it is necessary to support important hydrostatic underpressures.

3. Case of a Reinforcement Working Alternatively Under

Compression and Under Tension

Figure 12:
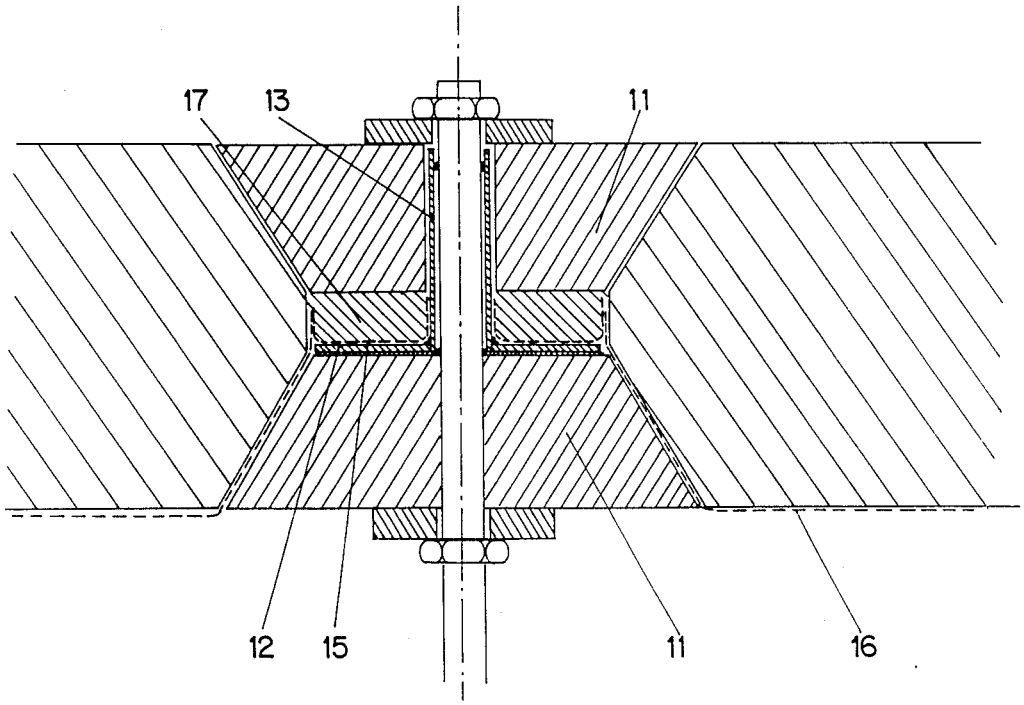

The head of pile-anchor, combination of both preceding cases, is then double conical, the watertightness organ being connected upon a protection tube equipped with a flange resting upon the upper face of the lower plug. It is represented on FIG. 12.

IV-APPLICATION OF THE PROCESS TO PLANE WORKS

1. State of the Art

In the present state of the art, a plane work in the ground is most often realised either by substitution or by grouting.

For example, for realizing a retaining wall inside the ground before digging an excavation, a trench is excavated in the soil and the soil is replaced for example by reinforced concrete (diaphragm wall process). For creating a watertightness wall in the soil, it is proceeded either as above mentioned or by grouting. If the excavation or the slope are already existing or if they are under execution and needed to be supported, a surface retaining organ is most often placed (shotconcrete or formed concrete), anchored or not in the soil by sealed anchors.

For realizing a drainage curtain, a network of linear drains is installed, or more seldom, a draining trench is constructed by replacing the soil with a drainage material.

All these processes are essentially based upon the use of foreign elements which are introduced into the soil in place of the original ground (concrete, various supporting organs) or inside it (injection grout, drains, anchors, etc.).

The process presently proposed consists in constituting the plane work (retaining, watertightness, drainage or composite work) by the mass of the soil itself, adequately treated for that purpose.

2. Principal of the Treatment

It consists in constituting the work with the soil itself, submitted to the following treatments:

(a) For a retaining and/or watertightness work, the soil is:

1. mechanically compacted
2. grouted
3. reinforced.

The compaction is obtained by simple mechanical effect, possibly combined with percussion and/or vibration effects. The reinforcement embedded in a sheath realizing tight junction with the soil. It may have a passive or active (prestressing) function.

(b) For a drainage work, the soil is:

1. mechanically decompacted
2. equipped with drains and/or pumping wells
3. the equipments are surrounded with filter bodies, with possible formation of enlarged bulbs.

The essential characteristic of the process lies in the fact that the ground itself is deeply altered and modified by the modifications which are produced by the combination of the preceding actions, and that after realisation of this treatment inside the volume of the plane work to be constructed, the treated ground itself constitutes the work.

3. Application Embodiments

A. Case of Retaining Works

In the case of retaining works, for example vertical or sloped retaining walls, the process consists essentially in forming a soil mass which is mechanically compacted, grouted and reinforced, and possibly precompressed, capable by its new characteristics after treatment to withstand the forces produced by earth pressure, and possibly water pressure, that will apply upon it.

The essential elements of the treatment are the following:

(a) The ground is mechanically compacted, by simple mechanical action of the auger helix, as previously explained. This simple mechanical compaction is supplemented if necessary by percussion effect and/or by vibration effect, acting upon the auger during its withdrawal and/or upon the reinforcement itself, as already explained above.

The result of this compaction is to modify the characteristics of the soil, enabling it to transmit more important efforts and at the same time reducing the corresponding deformations of the mass of the ground. The initial settlings at the time of the compaction may be compensated by bringing materials, either in solid state (for example aggregates, sand, gravel, etc. . . ) or in liquid state (for example mortar, concrete, grout, etc. . . ), which are introduced either at the top of the borehole, or in the heart of the soil mass, through the inside of the hollow auger stem, or through the special auxiliary tube previously described.

The introduction of the build-up material(s) may be realized by whatever combination of the three ways of introduction mentioned above.

(b) The ground is treated by grouting under pressure, as already explained.

This grouting treatment completes and strengthens the effect of the compaction described above, producing, according to the circumstances, mechanical characteristics of the treated soils which are far higher than their initial values.

Moreover when the retaining works should retain the water in addition to withstanding the earth pressure, the treatment by grouting produces in some circumstances a soil wall which is at the same time watertight and resisting.

(c) The ground is reinforced, that is to say it is equipped with reinforcements according to a grid corresponding to the grid of the treatment, or to a grid multiple of the latter. The reinforcements are tied up to the ground by a sheath which tightens them to it.

The way of installation of the reinforcements and the sheath has been already explained.

The reinforcements may be constituted by metallic, plastic or other material elements, or even by fillings with build-up materials, placed in solid state (for example gravels, dry concrete) or in liquid state (for example concrete, mortar, microconcrete, etc. . .).

Enlarged zones of the sheath or of the filling in granular materials may be formed at certain locations of the treatment, as previously explained.

The use of these reinforcements may be multiple:

1. They may work under compression, under tension and/or under shearing stress, in junction with the ground to which they are tied up by the sheath embedding them: in that case, they constitute a reinforcement of the ground and participate as such to the improvement of its mechanical characteristics.

2. They may be used for transmitting forces, along their axis, to the periphery of the mass of treated soil: in that case, they work for example as micropiles, transmitting compression forces towards the base of the work, or as anchors, realizing the anchorage of the work in the soil at its periphery.

3. These actions may be combined. Moreover, the reinforcements may be used for prestressing the ground, by anchoring in the soil near or under the work, and tensioning by taking hold upon a repartition structure at their free end. In such a case, the soil is not only compacted, grouted and reinforced, but it is also precompressed, which may be useful when it is desired to prevent the emergence of tensile stresses in the mass of the treated soil.

(d) The various effects described above (compaction, grout treatment, reinforcing, precompression of the ground) may be used according to all the desirable combinations, as the case may be, by applying either all the actions, or part of them only.

(e) The relative importance of the various actions between them may be controlled by servo-controls on the machine and on its associated grouting unit, with possibility to vary the relative values of the various parameters according to the various zones of the work.

B. Case of the Watertightness Works

In the case of the works designed only for watertightness, for example the impervious walls or diaphragms in the soil, or the watertight rafts in the ground underneath an excavation, the two main actions which are used are the mechanical compaction of the soil and its grouting under pressure.

It is possible to add to this treatment the placing of equipments, for example grouting sleeve tubes ("tubes à manchettes") which may be used for executing subsequent complementary grouting, in every place where it would be desired.

C. Case of the Retaining-Watertightness Dual Purpose Works

A combination of the treatments described in A and B above is used.

D. Case of the Drainage Works

In the case of the works designed for drainage, for example the draining walls or curtains in the soil, or the draining rafts (draining soil layer underneath the raft of a structure), the process consists essentially in forming a soil mass which is decompacted and equipped with drains and/or pumping wells, wrapped with filter bodies.

The essential elements of the treatment are the following:

(a) The ground is mechanically decompacted, as previously explained.

(b) The ground is equipped with drains and/or pumping wells as already explained.

The equipments are normally slotted metallic or plastic tubes, but they may also be, particularly in the case of drains, draining build-up material columns (aggregates, gravels or sand for example), Piezometric tubes are installed where necessary.

(c) Filter bodies in selected build-up materials are formed around the equipment tubes of the drains and/or pumping wells, along the catchment height of the ground.

(d) Enlargements of draining bodies (draining bulbs) are formed at the proper positions (for example at the lower part of the drains or pumping wells).

E. Case of the Combined Retaining-Drainage Works (a) When it is planned to realize a retaining work, for example before digging an excavation, a particular problem is often presented by the presence of a water bearing layer or by water circulations in the ground to be sustained. If the planned retaining structure is watertight, for example if it is constituted by a sheet pile or a concrete wall, it is necessary that it withstands the water pressure in addition to the earth pressure.

The present process makes it possible to realize combined works including a retaining part and a draining part. The latter one collects the water coming from the ground and makes it possible to lower the water table behind the retaining work, thus suppressing the hydrostatic water pressure upon the work. Thus we obtain a retaining-draining twin-layer work.

This process is evidently applicable to the cases when it is possible without drawback to lower the water table behind the work. This is specially the case when the permeability of soils behind the work is relatively low, as in that case it is possible to dispose of the water pressure upon the retaining work with only a low water extraction.

(b) Concerning the water extraction, it may be performed either by pumping in pumping wells, or by lateral outlets if existing, or by drilling subhorizontal drains from the excavation to connect the draining part of the retaining work with it, or otherwise from walled up wells located from place to place along the draining wall.

(c) It is possible to construct with this process as well retaining-draining twin-layer walls, vertical or inclined, as twin-layer horizontal rafts, for example a raft constituted by compacted-grouted-reinforced-anchored ground combined with a draining layer located above or underneath the latter.

(d) It is also possible to construct retaining-draining compound walls, for example by treating for resistance the upper part and for drainage the lower part of the wall.

F. Case of the Combined Watertightness-Drainage Works

The same process of twin-layer or compound walls and twin-layer rafts may be applied to combined works designed for realising the watertightness of the soil along a diaphragm and its drainage downstream of it.

In that case, the draining part of the twin-layer is located not upstream, but downstream of the impervious part.

G. Complex Retaining-Watertightness-Drainage-Ground Treatment Works

All the combinations of the preceding cases are possible, as it is possible to realize with the process all twin-layer or multi-layer walls, diaphragms and rafts in treated soil that may be desired. The process may also be applied to whichever combination of plane works with mass treatments and linear works as described above, or to whichever combination of the preceding works with known works.

4. Examples of Plane Works Realized with the Process

The following examples give only a picture of the works obtained with the process of the invention and they do not constitute a complete list of its possibilities.

A. Retaining Wall in Compacted-Grouted-Reinforced Soil (Vertical Treatment)

Figure 13:
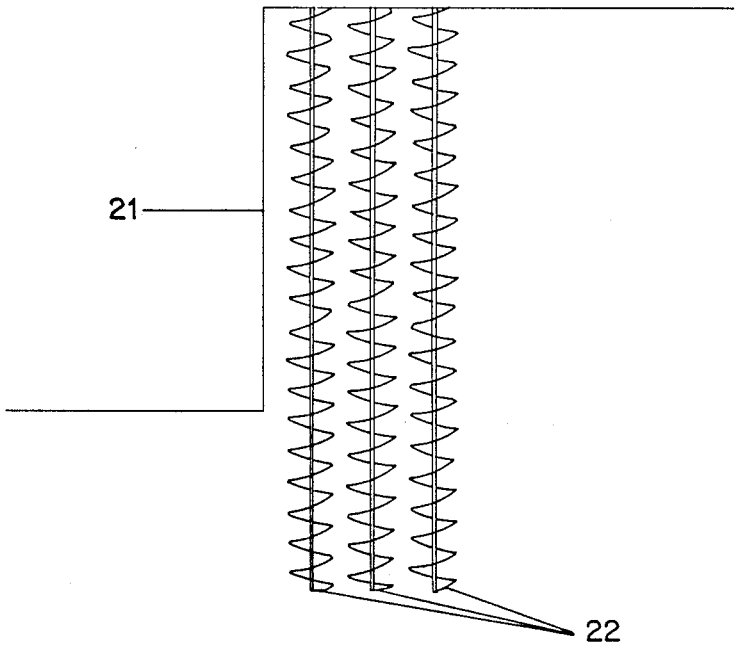
FIG. 13 is a diagrammatic and sectional view of a retaining wall constituted by a compacted-grouted-reinforced soil obtained according to an advantageous embodiment of the process of the invention.

FIG. 13 represents a retaining wall constituted by a compacted-grouted-reinforced soil which is realized before digging an excavation (21). The treatment here is executed with three lines of boreholes (22), treated according to the present process. In each borehole, a reinforcement is introduced, which is here for example a simple high yield steel bar. The reinforcements are embedded with a cement grout or mortar sheath, which tightens them to the ground. The soil itself, around the reinforcement and the sheath, is mechanically compacted, by simple mechanical action, possibly supplemented by percussion and/or vibration effects. It is grouted under pressure, for example with cement grout.

The so treated ground presents then such characteristics that is is able to retain the ground in natural state located at the rear.

B. Retaining Wall in Compacted-Grouted-Reinforced Soil (Inclined Treatment)

Figure 14:
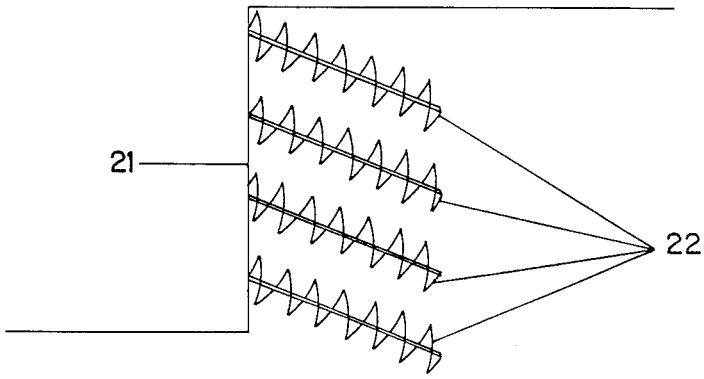
FIG. 14 is a variant of the view of FIG. 13 showing inclined equipments.

This example, represented on FIG. 14, is similar to the preceding example, except that the treating boreholes, sloped compared to the excavation surface, are executed as the excavation proceeds.

It is also possible to execute inclined treatments, similar to those described in A above, by boreholes parallel to the surface of the future excavation, in case of inclined excavations (embankments).

C. Retaining Wall in Compacted-Grouted-Reinforced-Precompressed Soil

Figure 15:
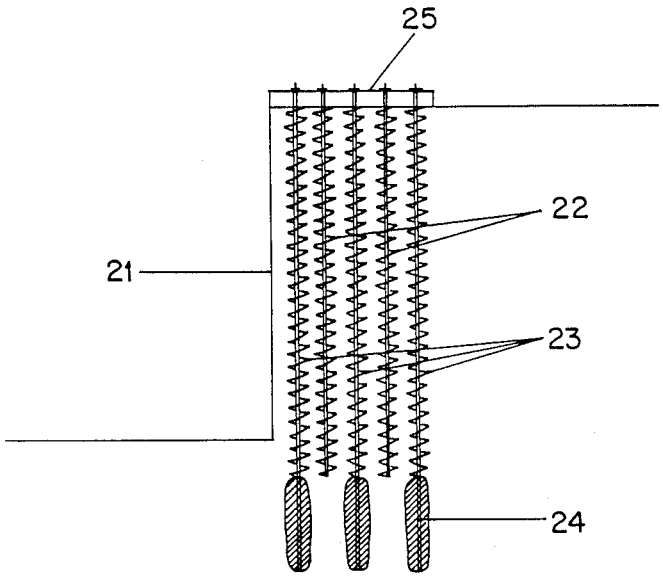
FIGS. 15, 16 and 17 are schematical and sectional views showing retaining walls obtained according to a preferred embodiment of the process of the invention, having mortar enlarged bulbs for improving anchoring.
Figure 16:
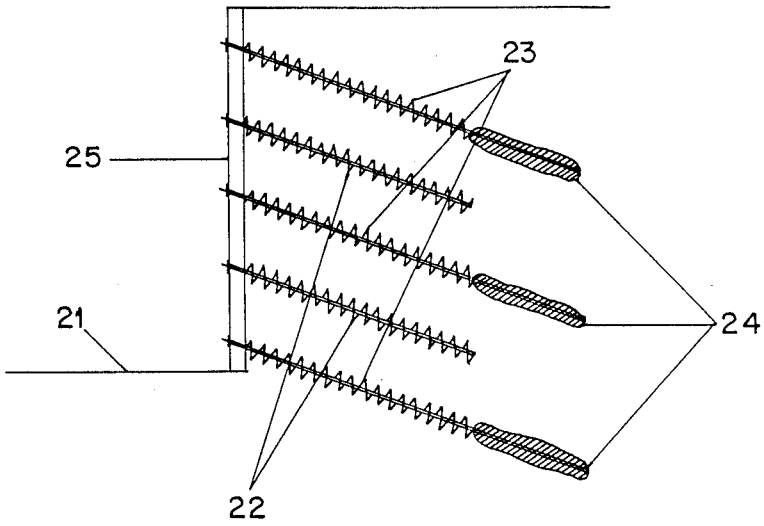
Figure 17:
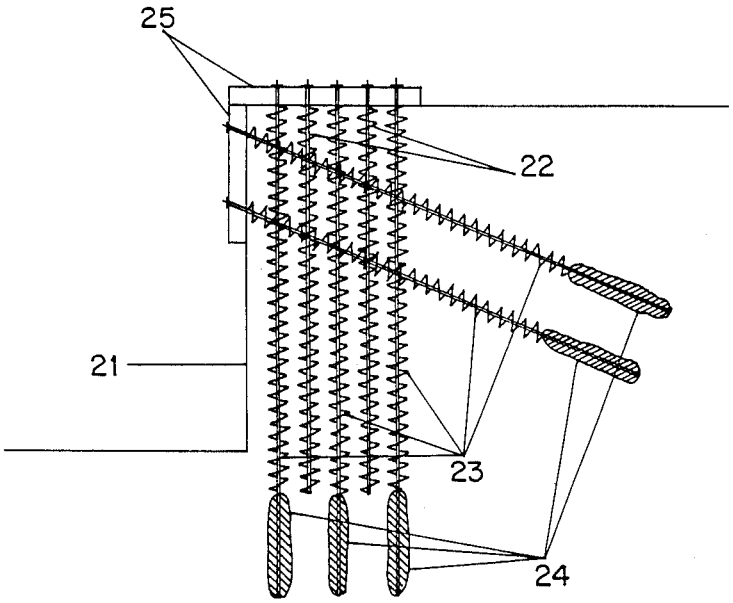

FIGS. 15, 16 and 17 represent retaining walls similar to the ones described above, but for which it is desired to add to the three actions of compaction, grouting and reinforcement of the soil, a precompression of the soil by prestressing tendons anchored in the ground underneath or behind the work.

In the represented examples, some boreholes (22) are simply equipped with passive reinforcements, while some others (23) are equipped with active anchors, which are anchored underneath or behind the work, in cement grout or mortar enlarged bulbs (24). The anchors are tensioned, before digging the excavation or progressively as it proceeds, upon continuous or discontinuous distribution structures (25), located at the surface.

D. Retaining-Draining Twin-Layer Wall

Figure 18:
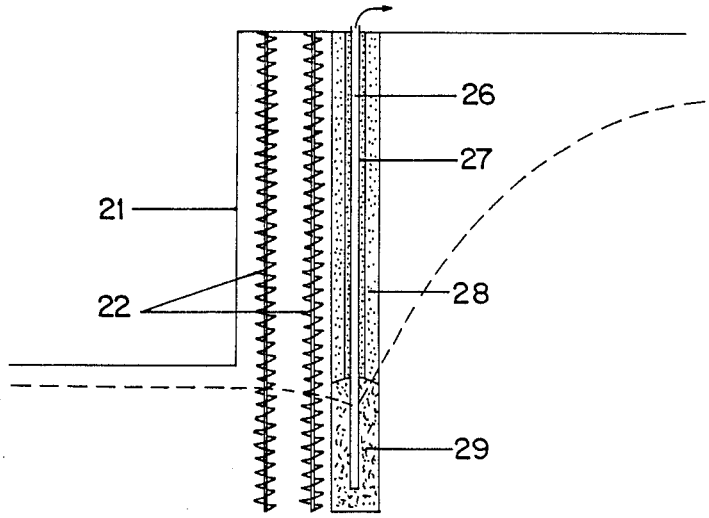
FIGS. 18, 19 and 20 are schematical and sectional views of retaining-draining twin-layer walls obtained according to an other embodiment of the process of the invention.
Figure 19:
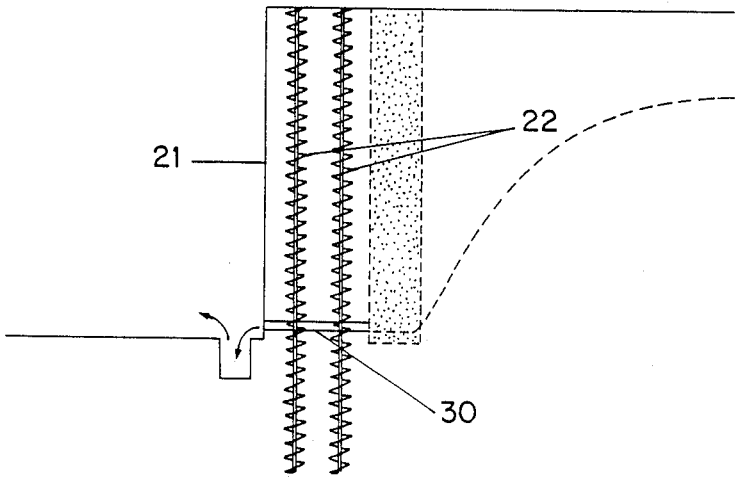
Figure 20:
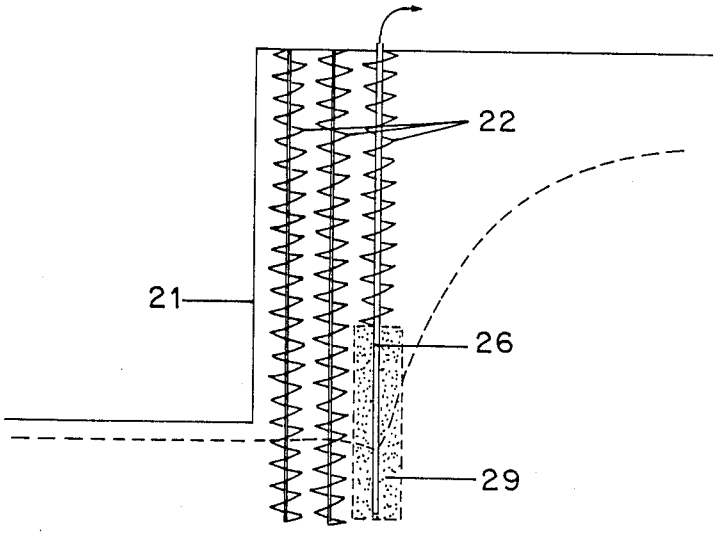

FIGS. 18, 19 and 20 represent examples of retaining-draining twin-layer walls.

The twin-layer wall is constituted by two parts:

1. A wall in compacted-grouted-reinforced (and possibly precompressed) soil, located facing the excavation, and designed for resistance. This wall is executed with boreholes (22) or (23), as explained above.

2. A draining wall, located at the rear, with drains and/or pumping wells (26), wrapped with filter sheaths (27) and with decompacted soil (28), with formation in the present case of enlarged draining bulbs (29) at the bottom.

The extraction of water for lowering the water table behind the retaining wall is performed either by pumping in some boreholes of the draining wall, as represented on figure 18, or by evacuation through subhorizontal drains (30) drilled from the excavation and catching the water collected by the draining wall, as represented on FIG. 19, or otherwise by lateral outlets, which could be natural if existing, or artificial (for example walled up wells located from place to place along the draining wall).

FIG. 20 represents a retaining-draining composite wall in which the lower part of the boreholes located earthside is treated for drainage and the upper part is treated for consolidation. The reinforcements, which in that case are tubular, are slotted at the lower part, which allows the drainage in that part.

E. Example of Composite Retaining-Drainage Work

Various configurations may be adopted for realizing retaining works, associated or not with drainage, according to the present process.

Figure 21:
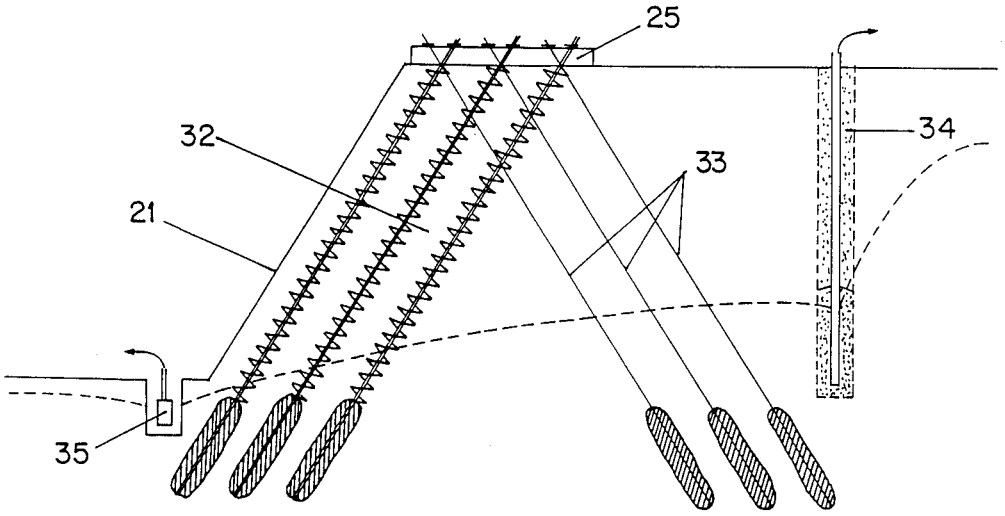
FIG. 21 is a composite retaining-drainage work obtained according to the invention.

FIG. 21 represents an example of such a work. In the case represented, an inclined front wall (32), constituted by a soil reinforced-compacted-grouted-precompressed with anchors sealed in the underlying ground, is associated with a network of prestressed anchors (33), sloping in the other direction. The whole set of anchors is tensioned against a distribution slab (25) located at the surface. A draining wall (34) produces the lowering of the water table behind the work. The water lowering is complemented by a simple network of sumps (35) at the bottom of the excavation.

F. Watertightness-Drainage Work

Figure 22:
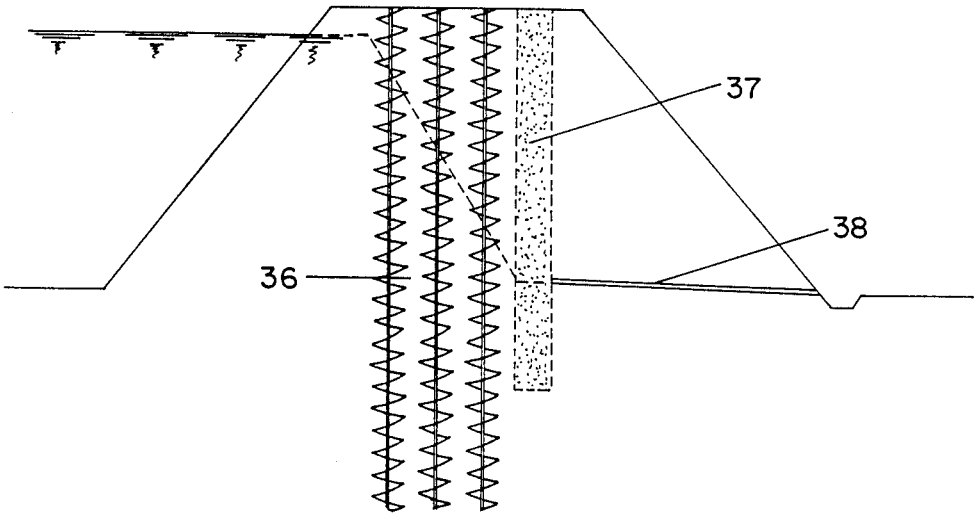
FIG. 22 is a watertightness-drainage work obtained according to the invention.

FIG. 22 represents a watertightness-drainage twin-layer wall for watertightening of a dyke. In that example, the upstream part of the twin-layer is a watertightness wall (36) constituted by soil which is compacted, grouted and equipped with grouting sleeve tubes ("tubes à machettes) for possible subsequent re-grouting. The downstream part of the twin-layer is a draining wall (37), the evacuation of the water collected by the draining wall being ensured with a network of subhorizontal drains (38) discharging in a gutter at the downstream toe of the dyke.

G. Examples of Twin-Layer Rafts

Figure 23:
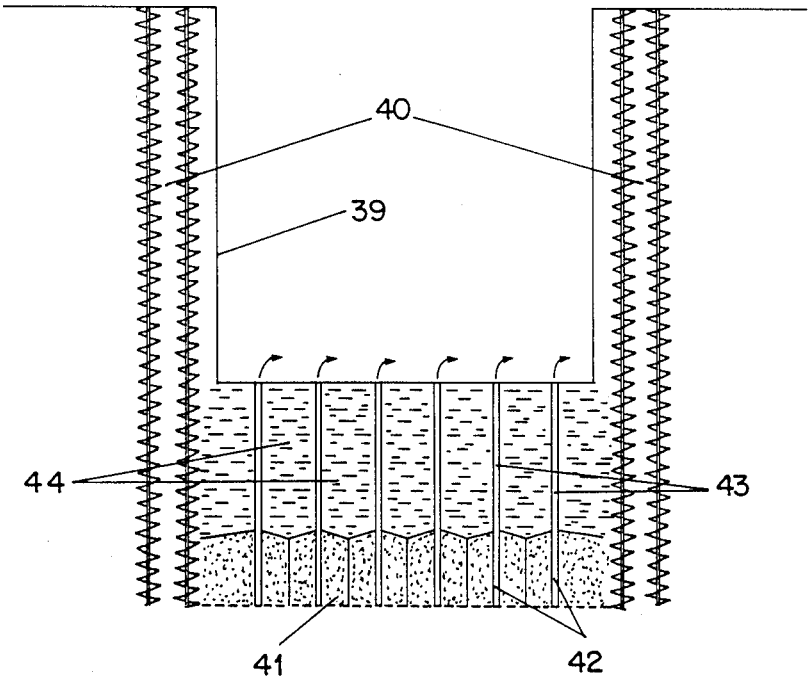
FIGS. 23 and 24 represent twin-layer rafts executed according to a preferred embodiment of the process of the invention.
Figure 24:
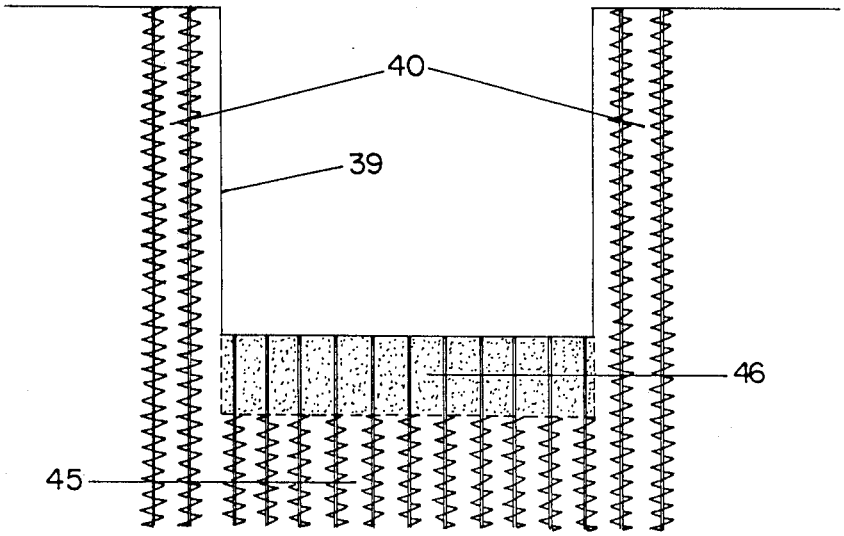

FIGS. 23 and 24 represent examples of twin-layer rafts executed according to the process.

Both examples relate to the execution of an excavation (39) in a water bearing ground. The excavation is supposed to be executed under shelter of retaining walls in reinforced-compacted-grouted and possibly precompressed walls (40), or possibly retaining-draining twin-layer walls (see D above).

The treatment of the raft is normally executed from the ground level before excavation, or in any case, from a level above the lowered water table level if there is a water lowering.

In the example represented on FIG. 23, the lower part of the twin-layer raft is draining: it is constituted by a series of bulbs in draining materials (41) (aggregates, sand or gravels for example), surrounding slotted catchment tubes (42). In the upper part of the twin-layer, the tubes (43) topping the above slotted tubes (42) are plain (unslotted). They are surrounding with mechanically compacted and grouted soil (44).

During digging the lower part of the excavation, the water collected in the lower part of the twin-layer is extracted by pumping, which reduces or suppresses the hydrostatic underpressure under the upper part.

In the example represented on FIG. 24, the configuration is opposite: the lower part of the twin-layer (45) is constituted by reinforced-compacted-grouted soil. It acts as an impervious raft and shall withstand the hydrostatic underpressure applying under its surface. The upper part of the twin-layer (46) is draining. It may be used for example as a drainage raft underneath the final structure.

It should be noted that in the above examples, both parts of the twin-layer raft may be executed with the same boreholes, in a single sequence of quick operations, as explained before.

In that case, the equipments may possibly play a composite role, ensuring drainage in the parts to be drained and reinforcement in the parts to be reinforced.

I claim:

1. A process for soil treatment and successive installations of a plurality of equipments at different respective locations in said soil comprising the operations of:

drilling the soil at one of said locations by driving a tubular stem tool having an axis and a predetermined overall diameter around said axis, into said soil, introducing one of said equipments inside the tubular stem tool, down to a corresponding predetermined position for said one of said equipments with respect to said soil, removing from the soil said tubular stem tool while leaving said one of said equipments within the soil in said corresponding predetermined position, modifying the soil compacity within at least part of said predetermined overall diameter around said one of said equipments by mechanical action, during at least part of the removal of said tubular stem tool, and repeating the above operations with each remaining one of said equipments at each remaining one of said respective locations.

2. The process according to claim 1, wherein modifying the soil compacity is performed with said tubular stem tool.

3. The process according to claim 2, wherein the tubular stem tool consists of a hollow helicoidal auger, comprising the operations of:

introducing said helicoidal auger into the soil by screwing into the soil said helicoidal auger, and removing said helicoidal auger from the soil by unscrewing the auger while giving to the auger for each turn of said auger an axial displacement different from the auger pitch, thereby modifying the compacity of the soil around said one of said equipments.

4. The process according to claim 2, wherein the tubular stem tool is vibrated when removed from the soil, thereby increasing the compacity of the soil around said one of said equipments.

5. The process according to claim 1, wherein said one of said equipments is vibrated during the tubular stem tool removal from the soil, thereby increasing the compacity of the soil around the equipment.

6. The process according to claim 1, further comprising introducing a build-up material around said one of said equipments while removing said tubular stem tool, therefore constituting a sheath of build-up material around said equipment.

7. The process according to claim 1, further comprising pressure grouting of the soil around said one of said equipments while removing the tubular stem tool by pumping a liquid hardening material such as a cement or chemical grout into the soil around said one of said equipments.

8. The process according to claim 1, wherein the tubular stem tool consists of a hollow helicoidal auger, further comprising during the removal of said helicoidal auger:

creating at least one enlarged hollow space within the soil around said one of said equipments by uplifting said helicoidal auger a predetermined distance, and introducing a build-up material at the bottom level of the helicoidal auger for filling said enlarged hollow space and establishing a corresponding enlarged zone or bulb of build-up material around said one of said equipments.

9. The process according to claim 1, wherein a build-up material is introduced through the space existing between the inner face of the tubular stem tool and said one of said equipments while removing said tubular stem tool.

10. The process according to claim 1, wherein drilling the soil by driving a tubular stem tool into said soil includes:

introducing a string of rods fastened to a drilling tool inside said tubular stem tool to drill a hard layer in the soil or an underlying rock and removing said string of rods and drilling tool from the tubular stem tool before introducing said one of said equipments and performing the remaining operations.

11. The process according to claim 1, comprising after drilling the soil by driving the tubular stem tool into said soil:

introducing an equipment having a drilling head into the tubular stem tool down to the bottom of said tubular stem tool, and rotating said equipment to drill a hard layer in the soil or an underlying rock with said drilling head before removing from the soil said tubular stem tool while leaving the equipment and its drilling head within the soil.

12. The process according to claim 1, comprising after introducing said one of said equipments inside the tubular stem tool:

connecting a string of rods to the top of said equipment and maintaining the equipment in place within the soil with said string of rods while removing from the soil said tubular stem tool around said string of rods.

13. The process according to claim 1 for successive installation of similar equipments, wherein the tubular stem tool is driven into the soil and a first equipment is introduced inside said tubular stem tool, a second equipment is installed on top of the first equipment, and the tubular stem tool is removed from the soil in a way such that said tubular stem tool includes said second equipment, whereby said second equipment is ready for its installation within the soil simultaneously with the driving of the tubular stem tool into the soil at an other location.

14. A process according to claim 1 for the installation of a flexible equipment wherein introducing the equipment consists in:

unwinding the flexible equipment from a feeding drum, carrying said equipment into the tubular stem tool, driving it into said tubular stem tool until the predetermined position with respect to the soil and, cutting said flexible equipment from the feeding drum, and wherein the tubular stem tool is removed from the soil in a way such that said tubular stem tool includes a new length of said flexible equipment, whereby said new length of flexible equipment is ready for its installation within the soil simultaneously with the driving of the tubular stem tool into the soil at an other location.

15. The process according to claim 1, further used for fixing an existing structure on the soil, wherein drilling the soil by driving a tubular stem tool into said soil is performed through a cylindrical frusto-conical ended hole performed in said structure, having a diameter slightly larger than the diameter of the tubular stem tool and wherein, after removing said tubular stem tool, the equipment is fixed to said structure with a frusto-conical plug cooperating with said frusto-conical ended hole.

16. The process according to claim 1, wherein modifying the soil compacity is performed at different depths within the soil along the equipment.

17. An apparatus for the successive installations of substantially linear equipments within a soil comprising:

(a) carrier means, (b) longitudinal displacement means including a mast, (c) an annular driving rotary head carried by the mast for rotation within both directions (d) a tubular stem helicoidal auger connected to said rotary head, for introduction within the soil, (e) means for feeding one of said equipments into the tubular stem auger through the annular driving rotary head, (f) means for controlling the rate of axial displacement and rotation of said tubular stem helicoidal auger whereby it permits a predetermined compaction or decompaction of the soil to be obtained around said one of said equipments while removing said tubular stem helicoidal auger.

18. The apparatus according to claim 17, further comprising a disconnectable bottom tool connected to the lower extremity of the tubular stem auger.

19. The apparatus according to claim 17, further comprising a stuffing box device for grouting while removing the tubular stem auger after leaving the equipment within the soil.

20. The apparatus according to claim 17, wherein the driving rotary head comprises a compound rotary percussion or a rotary vibration system.

21. The apparatus according to claim 17 further comprising at least one tube fixed to the tubular stem helicoidal auger for bringing fluid hardening material around and along the linear equipment within the soil.

22. The apparatus according to claim 17 further comprising an auxiliary driving head carried by the mast and independent from the annular driving rotary head for actuating said one of said equipments placed inside of said helicoidal auger while the annular driving rotary head actuates said helicoidal auger.

* * * * *